US005561258A

United States Patent [19]

Bentley et al.

[11] Patent Number: 5,561,258

[45] Date of Patent: Oct. 1, 1996

[54] MAGAZINE FOR PUMP ACTION SHOTGUN

[76] Inventors: James K. Bentley, 2489 Starling Dr., Paso Robles, Calif. 93446; Willard H. Crawford, 1836 Orange St., Bakersfield, Calif. 93004

[21] Appl. No.: 541,618

[22] Filed: Oct. 10, 1995

[51] Int. Cl.[6] ..... F41A 9/74

[52] U.S. Cl. ..... 89/33.17; 89/33.02; 42/49.01

[58] Field of Search ..... 89/33.17, 33.02, 89/33.1, 34; 42/19, 49.01

[56] References Cited

U.S. PATENT DOCUMENTS

| | | | |
|---|---|---|---|
| 2,321,720 | 6/1943 | Whittaker | 89/33.02 |
| 3,239,959 | 3/1966 | Sefried, II et al. | 42/19 |
| 4,445,418 | 5/1984 | Sullivan et al. | 89/33.02 |

FOREIGN PATENT DOCUMENTS

| | | | |
|---|---|---|---|
| 168477 | 6/1934 | Switzerland | 89/33.02 |
| 539414 | 9/1941 | United Kingdom | 89/33.02 |

*Primary Examiner*—Stephen M. Johnson
*Attorney, Agent, or Firm*—Charles C. Logan, II

[57] ABSTRACT

A magazine filled with ammunition that can be quickly and easily attached to and detached from a firearm. It has a housing with a chimney section that has an outlet port at its top end for feeding the ammunition into the firearm. There is an annular chamber in the housing of the magazine and it contains a spring-loaded drum. A pair of laterally spaced cog gears are mounted on the drum for capturing ammunition shells and transporting them along a circular axis until they reach the vertical linear axis of the chimney section. A follower assembly pushes the ammunition shells up through the chimney section. A shell retainer unit is mounted in the chimney section for preventing shells from exiting its outlet port when the magazine is detached from the firearm. The shell retainer unit is deactivated by a depressor member that moves downwardly when the magazine is attached to the firearm. A feed lip assembly is pivotally mounted adjacent the top end of the chimney section.

13 Claims, 2 Drawing Sheets

MAGAZINE FOR PUMP ACTION SHOTGUN

BACKGROUND OF THE INVENTION

The invention relates to pump action shotguns and more specifically to a magazine to be loaded with shotgun shells.

Presently pump action shotguns have structure which restricts the number of shotgun shells that can be loaded in its magazine tube to five shells. When all five shells have been fired, it is necessary to turn the shotgun over and physically load one shell at a time into the magazine tube. This is an unreasonable delay when the weapon is in the hands of a military person in a life threatening situation. The same problem would exist for police officers or swat team members that use the pump action shotgun. The prolonged period for reloading the shotgun also affects skeet shooters when competing in competitions.

Recently the inventor has been able to modify a conventional pump action shotgun so that it will function with a magazine loaded with shotgun shells. This magazine will presently hold ten shotgun shells.

It is an object of the invention to provide a novel magazine for a pump action shotgun that can be quickly and easily attached and removed from the shotgun.

It is another object of the invention to provide a novel magazine for a pump action shotgun that would be economical to manufacture and market.

It is a further object of the invention to provide a novel magazine for a shotgun that can be attached to the shotgun using one hand or removed from the shotgun using one hand.

It is an additional object of the invention to provide a novel rotary magazine for a firearm that self-charges its spring-loaded follower assembly as the magazine is being loaded with shells.

It is another object of the invention to provide a novel rotary magazine for a shotgun that is relatively compact and not difficult to reach around when actuating the forearm of a pump action shotgun.

It is also an object of the invention to provide a novel magazine for a shotgun that accepts shotgun shells having different lengths.

It is a further object of the invention to provide a novel rotary magazine for a shotgun that has novel structure that allows the front ends of the shotgun shells to travel around the interior of the magazine in a cantilevered manner without requiring any support for the shotgun shells adjacent their front ends.

It is another object of the invention to provide a novel rotary magazine for a shotgun that allows the magazine to be quickly and easily loaded or downloaded.

SUMMARY OF THE INVENTION

The invention relates to a novel magazine that can be used with a modified pump action shotgun. The inventor's novel structure for a magazine loaded pump action shotgun can be incorporated into existing pump action shotguns by doing minimal modification of existing structure or by use of a retrofit kit. The novel structure can also be incorporated into new pump action shotguns so that they would be originally manufactured with a quickly attachable and detachable shotgun shell magazine.

The novel magazine has a substantially circular drum shaped housing with a vertically extending chimney section. A tubular drum has its opposite ends journaled with respect to the inner surfaces of the front and rear walls of the housing. An annular chamber is formed in the housing with its inner surface being defined by the outside surface of the tubular drum. The remainder of the annular chamber is formed by the respective front wall, rear wall, top wall, bottom wall, left side wall and right side wall of the housing. The annular chamber has a circular axis. The chimney section has a linear chamber having an outlet port at its top and an inlet port at its bottom end. The linear axis of the chimney section substantially intersects the circular axis.

The top end of the chimney section has vertical grooves adjacent its rear wall for receiving the brass flange on the end of a shotgun shell. The respective vertical grooves in the chimney section mate with annular grooves in the circular drum shaped housing so that the brass flange on the shotgun shells is positively captured as they travel along their entire circular path in the circular drum shaped housing and also their linear path up through the chimney section. This eliminates the need to provide any type of support for the front ends of the shells. The total groove system positively captures the brass flanges of the shotgun shells and keeps them from jamming when the shotgun is rapidly fired. The structure that positively captures the rear ends of the shotgun shells allows shotgun shells of different lengths to be used in the magazine. These shotgun shells of different lengths do not require any support structure for the front ends of the shotgun shells. The longitudinal axes of the shotgun shells remain substantially horizontal and parallel to each other as they travel through the magazine.

The magazine has structure for spring loading its follower assembly that forces the shotgun shells around the circular axis of the annular chamber and up through the chimney section into the shotgun. The spring loaded structure self-charges itself as the shotgun shells are loaded into the magazine.

An elevator arm has its rear end pivotally connected to the tubular drum inside the magazine housing. The front end of the elevator arm is secured to the rear end of the follower assembly which is pushing the shotgun shells out of the magazine. The elevator arm along with the articulated carriage of the follower assembly allows the last shells in the magazine to be first carried along a circular axis and then directed upwardly along a vertical linear axis all of the way to the outlet port of the chimney section.

The magazine also has a shell retainer unit mounted in the chimney section for preventing shells from exiting the outlet port of the chimney section when the magazine is detached from a firearm. The shell retainer unit has a spring-loaded lip that is biased to block the outlet port of the chimney section when the magazine is not attached to a firearm. The spring loaded feed lip is pivotally mounted on a depressor member. The depressor member is moved downwardly when the magazine is attached to a firearm and this causes the feed lip to be withdrawn from the outlet port of the chimney section and this allows the shells to exit the outlet port and into the feed lip assembly and then into the barrel of the firearm where they are fired.

The feed lip assembly has a pair of laterally spaced side walls having upper portions that curve toward each other to capture a shotgun shell when the depressor of the shell retainer unit has been depressed. A slot in the back wall of the feed lip assembly allows the tang on the bolt of the shotgun to travel forwardly and transport the shotgun shell into the firing chamber. Spring arms extend forwardly from each of the side walls of the feed assembly and they have tabs adjacent front ends that extend transversely to be releasably captured in respective recesses on the interior of the respective left and right side walls of the chimney section.

The magazine can be loaded or downloaded quickly by squeezing the spring fingers of the feed lip assembly together until they are removed from their respective recesses. The feed lip assembly is then pivoted upwardly about its rear end to remove all of the shell capturing structure that had been above the exit port of chimney section. By depressing the depressor of the shell retainer unit all of the shotgun shells in the magazine will be rapidly ejected. Also with the depressor depressed, individual shotgun shells can be quickly and easily loaded into the magazine at which time the depressor is released and the spring loaded retainer lip would travel into the exit port of the chimney section and prevent upward travel of the shotgun shells. The feed lip assembly would be pivoted back to its closed position and it's tabs inserted into its respective recesses in the interior of the chimney section.

The unique structure at the top end of the chimney section and the mating structure of the magazine adapter allow the magazine to be changed by the firearm operator by the use of only one hand. The magazine can be quickly and easily attached and detached from the shotgun.

DESCRIPTION OF THE PREFERRED EMBODIMENT

Figure 1:
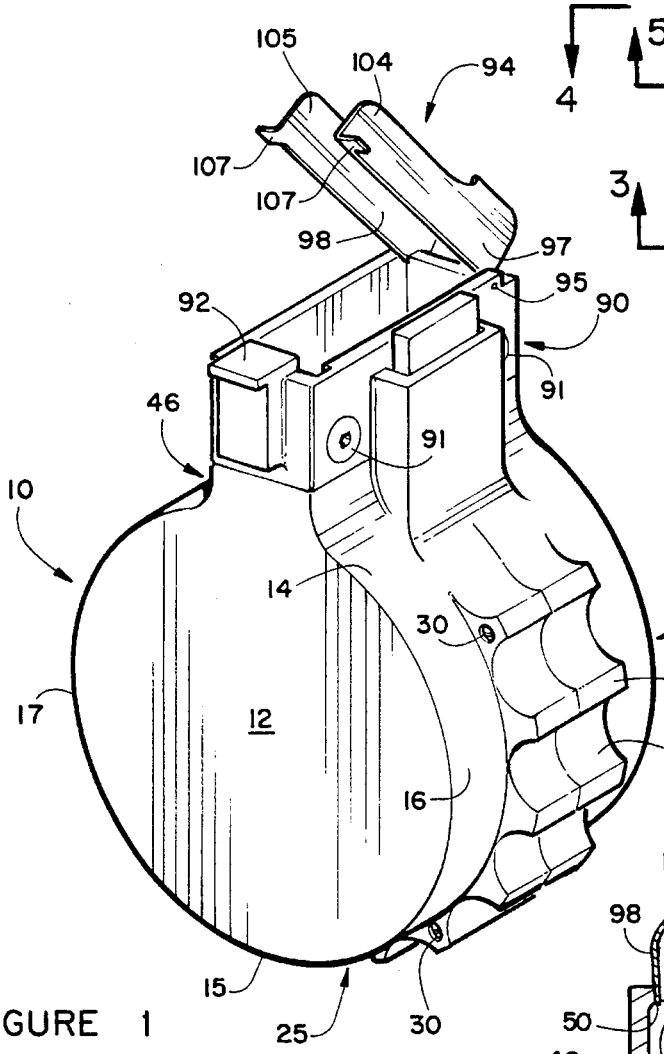
FIG. 1 is a front perspective view of the novel magazine for a pump action shotgun.
Figure 2:
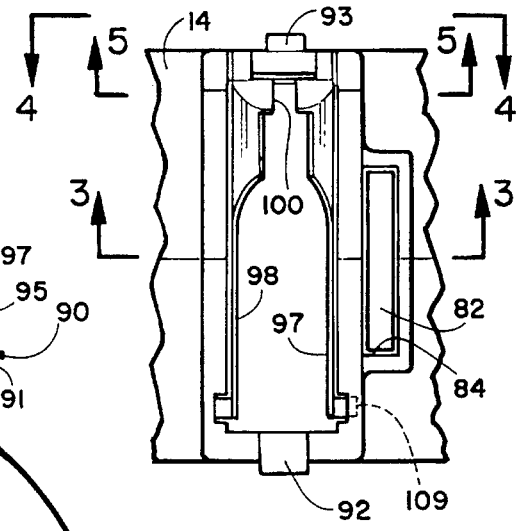
FIG. 2 is an partial top plan view of the magazine illustrating the interior of the chimney section.
Figure 4:
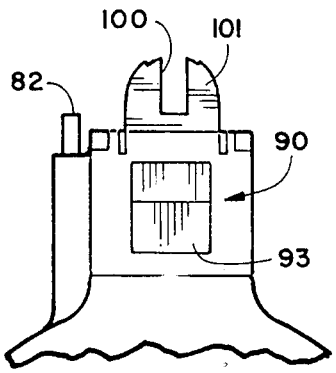
FIG. 4 is a partial rear elevation view of the magazine and more specifically its chimney section.

The novel magazine for a pump action shotgun will now be described by referring to FIGS. 1–6 of the drawings. The magazine is generally designated numeral 10. Its top end would be detachably inserted into the aperture in the bottom of the receiver of a shotgun through which it is normally loaded. The modified shotgun (not illustrated) has novel structure that is disclosed in a co-pending patent application.

Shotgun shell magazine 10 has a front wall 12, a rear wall 13, top wall 14, a bottom wall 15, a left side wall 16 and a right side wall 17. Finger gripping ridges 19 separated by concave recesses 21 are formed on the outer surface of the housing of the shotgun shell magazine 10. The housing is preferably formed from molded plastic and it has a front half 25 and a rear half 27. Rear half 27 has a groove (not shown) extending around most of its periphery that mating receives a ridge or tongue (not shown) extending outwardly from the rear surface of front half 25. Screws 30 secure the two halves together.

The inner structure of front half 25 and rear half 27 are substantially the same but reversed in their orientation. A recess 31 is formed on the inner surface of each of the respective front and rear walls 12 and 13 and they receive the opposite ends of rod 32. Rod 32 is a longitudinally extending slot 34 for receiving one end of a flat coiled spring 36 whose opposite end is captured in notch 38. The inner surfaces of these respective walls each have an inwardly extending boss 40 that fits into the opposite ends of a tubular drum 42 which is journaled thereon for rotational travel. An annular chamber 44 having a circular axis is formed between the outer surface of tubular drum 42 and the inner surface of front wall 12, rear wall 13, top wall 14, bottom wall 15, left side wall 16 and right side wall 17. Chimney section 46 has an inlet port 48, a linear chamber 49, and an outlet port 50.

Tubular drum 42 has a pair of laterally spaced cog gears 52 formed on its outer surface whose structure functions to capture shotgun shells 54 so that they can be carried along annular chamber 44 toward inlet port 48 of chimney section 46 as drum 42 rotates. Tubular drum 42 is spring loaded to rotate with respect to the front and rear walls of the housing. When shotgun shell magazine 10 is loaded, shotgun shells 54 are continuously inserted into chimney section 46 and as the shells engage cog gears 52, tubular drum 42 is caused to rotate until the rear end of shell ammunition follower assembly 60 rotates into contact with a stop limit wall 62 that extends into annular chamber 44. This limits the rotational travel of tubular drum 42 to less than 360 degrees.

Shell ammunition follower assembly 60 is in the form of an articulated carriage 64 having a pair of laterally spaced rollers 66 and 67 secured together by a connecting member 68. An elevator arm 70 has its front end connected to roller 67 and its rear end connected by a pivot pin 71 to tubular drum 42. Elevator arm 70 pushes shell ammunition follower assembly 60 along a rotational path through the annular chamber 44 and then lifts the shell ammunition follower assembly 60 along a vertical linear path through the linearly extending chamber 49 of chimney section 46 to its outlet port 50.

The shotgun shell magazine has a shell retainer unit 77 mounted in chimney section 46 for preventing shotgun shells 54 from exiting outlet port 50 when the magazine is detached from the shotgun. Shell retainer unit 77 has a spring loaded retainer lip 79 that is biased to block the outlet port 50 of chimney section 46 when the magazine is not attached to a firearm. Spring loaded retainer lip 79 is pivotally mounted by pin 80 on depressor member 82. The bottom end of depressor member 82 is in contact with spring 83 that is positioned in groove 84.

When chimney section 46 of the shotgun shell magazine is inserted into the bottom end of the receiver of a shotgun, the bottom edges of the receiver will force depressor member 82 downwardly. This causes feed retainer lip 79 to be withdrawn from the outlet port 50 and allows the shotgun shells 54 to pass through outlet port 50 and into the shotgun where they may be fired. An annular groove 86 is formed between the inner surface of rear wall 13 and the rear edge 87 of tubular drum 42. Another annular groove 88 is formed adjacent rear wall 13 along the inner surface of the circular housing of the magazine. The width of annular grooves 86 and 88 is slightly larger than the width of the flange on the brass sleeve located on the end of a shotgun shell. The annular grooves 86 and 88 positively capture the flanges on the shotgun shells and allows different length shells to be used. The annular grooves eliminates the need to have vertical tracks on the inside wall of chimney section 46 to keep the shells from jamming.

Figure 3:
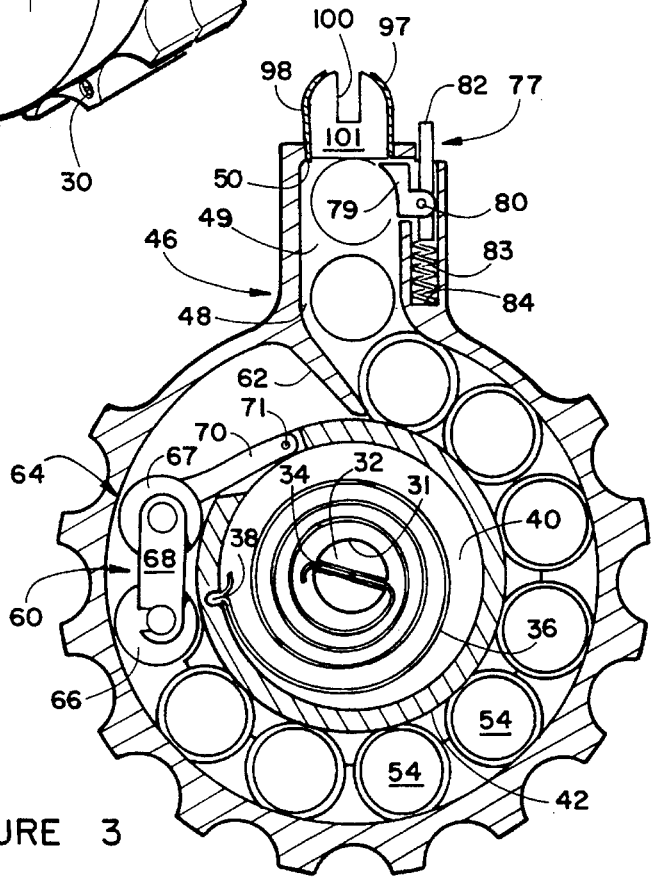
FIG. 3 is a cross sectional view taken along lines 3—3 of FIG. 2.
Figure 5:
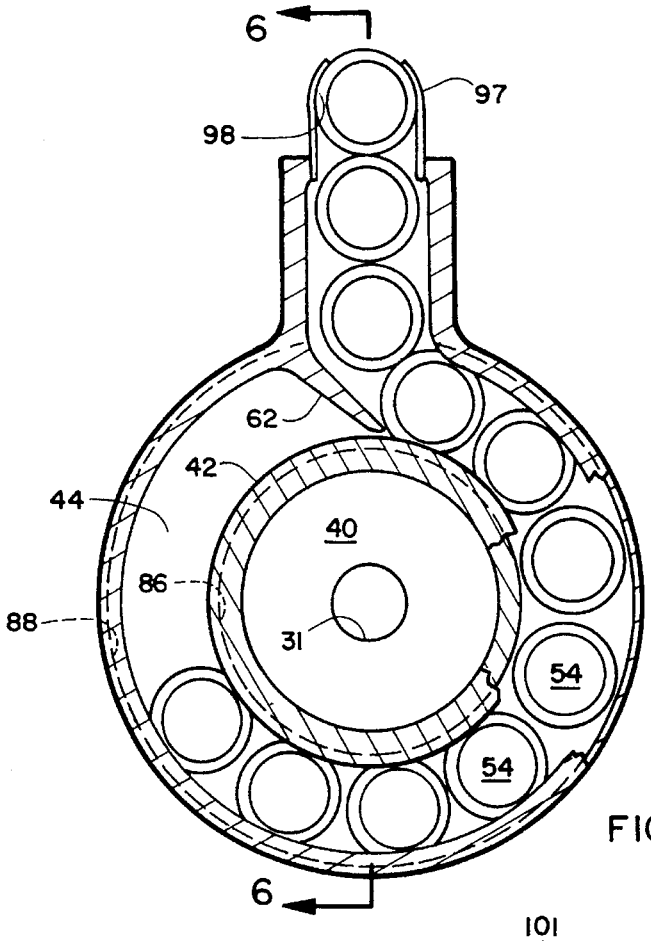
FIG. 5 is a vertical cross sectional view taken along lines 5—5 of FIG. 2.
Figure 6:
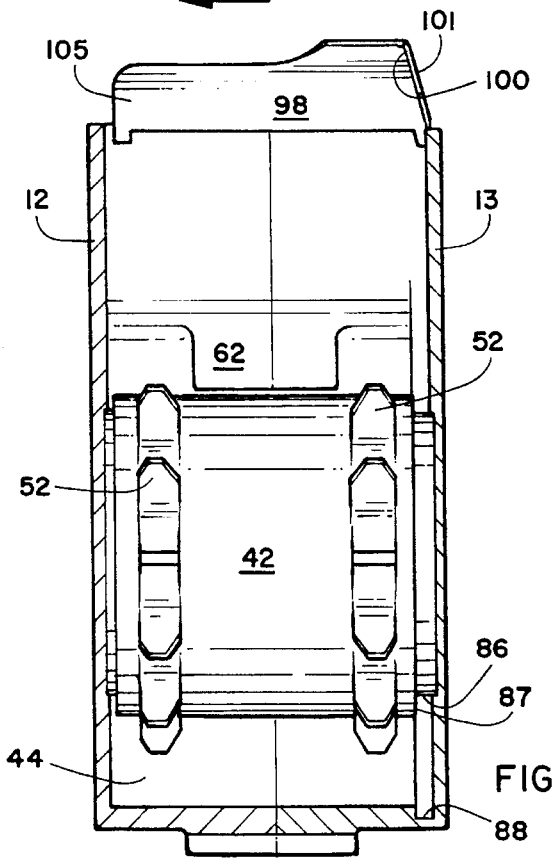
FIG. 6 is a cross sectional view taken along lines 6—6 of FIG. 5.

FIGS. 3, 5 and 6 show how the flanges 55 of the shotgun shells are captured in the respective annular grooves 86 and 88.

A metal band 90 is secured to the outer surface of chimney 46 by screws 91. A front locking lug 92 and a rear locking lug 93 extend from the respective front and rear ends of metal band 90. These are captured by cooperating structure in the bottom of the receiver of the pump action shotgun.

A feed lip assembly 94 has its rear end pivotally secured by pins 95 to the top end of metal band 90. Feed lip assembly 94 has a left side wall 97, a right side wall 98, and they each have upper portions that curve inwardly toward each other. A slot 100 is formed in rear wall 101 and it allows the tang on the bolt of the shotgun to pass therethrough and deliver the shotgun shell into the barrel of the gun where it is fired. A spring arm 104 and a spring arm 105 extend forwardly from the respective side walls 97 and 98. Tabs 107 extend transversely from the respective spring arms and they are received in recesses 109 of the respective left and right side walls of chimney 46.

What is claimed is:

1. A magazine for a firearm comprising:

a housing having a front wall, a rear wall, a top wall, a bottom wall, a left side wall and a right side wall;

said front wall having an inner surface and said rear wall having an inner surface; a tubular drum having an outer surface also has opposite ends that are journaled in said respective inner surfaces; an annular chamber is formed in said housing with the inner surface being defined by the outer surface of said tubular drum and the outer surface of said annular chamber being defined by said top wall, said bottom wall, said left side wall and right side wall;

said housing having a substantially vertical tubular chimney section having a top end, a bottom end, a front wall and a rear wall; an outlet port is formed in the top end of said chimney section and an inlet port is formed in the bottom end of said chimney section; said tubular chimney section having a linearly extending chamber and its bottom end is in communication with said annular chamber;

means for spring loading said drum so that the drum will rotate with respect to the front and rear walls of said housing;

means on the outer surface of said tubular drum for capturing ammunition shells so that they can be carried along said annular chamber toward the inlet port of said chimney section as said drum rotates;

a shell ammunition follower assembly having a front end and a rear end, said shell ammunition follower assembly travels immediately behind a last round of ammunition and pushes it forwardly toward the outlet port of said chimney section of said magazine;

means for connecting the rear end of said shell ammunition follower assembly to said rotating drum;

a shell retainer unit mounted in said chimney section for preventing shells from exiting the outlet port of said chimney section when said magazine is detached from a firearm; and a feed lip assembly having a front end and a rear end, means for moving said feed lip assembly into and out of a position covering the outlet port of said chimney section.

2. A magazine for a firearm as recited in claim 1 wherein said feed lip assembly comprises:

left and right laterally spaced side walls each having a front end, a rear end, and an upper portion, said respective upper portions curving toward each other so that they contain the upward travel of an ammunition shell exiting from the outlet port of said chimney section.

3. A magazine for a firearm as recited in claim 2 wherein the side walls of said feed lip assembly each have a forwardly extending spring arm and means for detaching restraining said spring arms adjacent the outlet port of said chimney section.

4. A magazine for a firearm as recited in claim 3 wherein said means for moving said feed lip assembly into and out of a position covering the outlet port of said chimney section comprises hinge structure adjacent the rear end of said feed lip assembly that allows it to be pivoted about the rear wall of said housing.

5. A magazine for a firearm as recited in claim 1 wherein said housing and chimney section is molded from plastic material and it has a front half and a rear half that interlock together.

6. A magazine for a firearm as recited in claim 1 wherein the top wall, bottom wall, left side wall and right side wall of said housing form a generally circular-shaped wall.

7. A magazine for a firearm as recited in claim 6 further comprising finger gripping ridges are formed on the generally circular-shaped wall.

8. A magazine for a firearm as recited in claim 1 further comprising means for limiting the rotation of said tubular drum to less than 360 degrees.

9. A magazine for a firearm as recited in claim 1 wherein said means on the outer surface of said tubular drum for capturing ammunition shells comprises a pair of laterally spaced cog gears that are rigidly secured to the outer surface of said tubular drum.

10. A magazine for a firearm as recited in claim 1 wherein said shell retainer unit has a spring-loaded feed lip that is biased to block the outlet port of said chimney section when the magazine is not attached to a firearm.

11. A magazine for a firearm as recited in claim 10 wherein said spring-loaded feed lip is connected to a depressor member.

12. A magazine for a firearm as recited in claim 11 wherein said shell retainer unit has means for moving said depressor member downwardly when said magazine is attached to a firearm and this causes said feed lip to be withdrawn from the outlet port of said chimney section and this allows the shells to exit said outlet port and into a firearm where they are fired.

13. A magazine for a firearm as recited in claim 12 wherein said means for moving the depressor member downwardly has spring means on the bottom of said depressor that keeps it normally in its upper position.

* * * * *